US009089887B2

(12) United States Patent
Snyder et al.

(10) Patent No.: US 9,089,887 B2
(45) Date of Patent: Jul. 28, 2015

(54) LINE THREADING DEVICE AND METHOD

(71) Applicant: SAMUEL STEEL PICKLING COMPANY, Twinsburg, OH (US)

(72) Inventors: Rick Lee Snyder, Hudson, OH (US); Richard David Ganiere, Strongsville, OH (US); Victor DeVon Gardener, Bedford Heights, OH (US); George Wayne Hartman, Jr., Wickliffe, OH (US)

(73) Assignee: Samuel Steel Pickling Company, Twinsburg, OH (US)

( * ) Notice: Subject to any disclaimer, the term of this patent is extended or adjusted under 35 U.S.C. 154(b) by 284 days.

(21) Appl. No.: 13/709,369

(22) Filed: Dec. 10, 2012

(65) Prior Publication Data

US 2014/0157849 A1 Jun. 12, 2014

(51) Int. Cl.
*B21C 47/34* (2006.01)

(52) U.S. Cl.
CPC ..... *B21C 47/3433* (2013.01)

(58) Field of Classification Search
CPC ..... B21B 39/02; B21B 39/04; B21B 39/06; B21B 39/14; B21B 39/16; B21B 39/165; B21B 33/00; B21B 2015/0064; B21C 47/16; B21C 47/3433; B21C 47/18; B21C 47/20; B21C 47/22; B21C 47/34; B65H 23/04; B65H 23/26; B65H 23/34; B65H 2301/522; B65H 2301/52202; B65H 2301/521
USPC ..... 72/127, 133, 146, 183, 198, 210, 226, 72/250, 419, 426, 428; 198/867.11, 198/803.14; 226/196.1, 91, 92; 248/300, 248/346.06, 678, 378; 269/329, 903, 289 R; 242/548, 548.2, 548.3, 566, 615, 615.4
See application file for complete search history.

(56) References Cited

U.S. PATENT DOCUMENTS

| | | | | |
|---|---|---|---|---|
| 1,903,638 | A * | 4/1933 | Sykes | 72/302 |
| 4,389,254 | A | 6/1983 | Tusset et al. | |
| 4,986,291 | A * | 1/1991 | Hula et al. | 134/122 R |
| 6,398,876 | B1 | 6/2002 | Starcevic et al. | |

FOREIGN PATENT DOCUMENTS

JP 05154533 A * 6/1993

* cited by examiner

*Primary Examiner* — Shelley Self
*Assistant Examiner* — Peter Iannuzzi
(74) *Attorney, Agent, or Firm* — Renner, Kenner, Greive, Bobak, Taylor & Weber

(57) ABSTRACT

An improved method for processing coiled metal sheet is provided, wherein a line threading device is inserted between the metal sheet and the process line surface at the leading edge of the metal sheet. The device is rigid and adapted to glide easily along the process line surface when propelled in a forward direction. The device has an upper surface that includes a plurality of grooves that run perpendicular to the forward direction, and the leading edge of the sheet, when it curves toward the process line surface, does not come into contact with a recess of the process line surface, but instead becomes lodged in a groove of the device, which guides the sheet along the process line surface, and does not impede forward progress.

6 Claims, 1 Drawing Sheet

LINE THREADING DEVICE AND METHOD

TECHNICAL FIELD

In one or more embodiments, the present invention relates to a line threading device for guiding metal sheet such as steel through a processing line.

BACKGROUND OF THE INVENTION

Sheet metal is typically formed by hot rolling process and, if the gauge is thin enough, it is coiled for convenient transport and storage.

The most common method of removing all oxide from the surface of hot rolled sheet metal is a process known as pickling, or pickle and oil. In this process, the steel (already cooled to ambient temperature) is uncoiled and pulled through a bath of acid to chemically remove the scale. Then, after the scale has been removed, the steel is washed, dried, oiled to protect it from rust damage, and recoiled.

During the pickling process, the sheet metal passes over and/or through a plurality of rollers and may encounter one or more gaps as it travels through the process line. In other words, the surface over which the sheet metal passes during the pickling process is not solid, but may contain recesses such as gaps, crevices, or edges. In the past, problems have occurred when the leading edge of the sheet dips into a recess and forward progress is impeded. Having to manually reach into the process line in order to free the leading edge of the sheet metal can be a safety hazard for line operators.

SUMMARY OF THE INVENTION

In one or more embodiments, the present invention provides an improved method for processing coiled metal sheet. In a process in which the coiled metal sheet is uncoiled to form a sheet having a leading edge, wherein the leading edge is advanced along a process line surface in a forward direction, wherein the leading edge may curve toward the process line surface, wherein said process line surface includes a recess, and wherein the leading edge of the sheet may become lodged in the recess, thereby impeding the forward progress of the sheet, the improvement comprising inserting a line threading device between the metal sheet and the process line surface at the leading edge of the metal sheet, wherein the device is rigid and adapted to glide easily along the process line surface when propelled in a forward direction, wherein the device has an upper surface that includes grooves that run perpendicular to the forward direction, wherein the leading edge of the sheet, when it curves toward the process line surface, does not come into contact with a recess of the process line surface, but instead becomes lodged in the groove of the device and propels the device along the process line surface, without impedence of the forward process of the sheet.

In one or more embodiments, the present invention further provides a line threading device, wherein the line threading device may be inserted between a metal sheet and a process line surface at the leading edge of the metal sheet, wherein the device is rigid and adapted to glide easily along the process line surface when propelled in a forward direction, wherein the device has an upper surface that includes grooves that run perpendicular to the forward direction, wherein the leading edge of the sheet, when it curves toward the process line surface, does not come into contact with a recess of the process line surface, but instead becomes lodged in the groove of the device and propels the device along the process line surface, without impedence of the forward process of the sheet.

DETAILED DESCRIPTION OF ILLUSTRATIVE EMBODIMENTS

Figure 1:
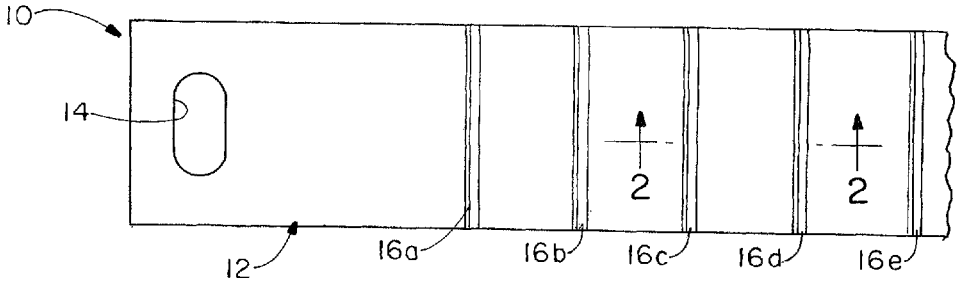
FIG. 1 is a partial top view of a line threading device according to one embodiment of the invention.

Referring to FIG. 1, it can be seen that a section of a line threading device according to the present invention is generally indicated as 10. Device 10 includes a top surface 12, handle cut-out 14, and a plurality of grooves. For purposes of clarity in describing the embodiment illustrated in FIG. 1, each groove has been given a unique designation: 16*a-e*. As further described below, the number of grooves, the spacing between grooves, and the position of the grooves relative to each other is not particularly limited, and the configuration and function of the grooves is essentially the same. Furthermore, the portion of device 10 that is not shown in FIG. 1 could contain additional grooves 16*x*. Therefore, where a groove is merely referred to as "16", it will be understood that the reference could apply to any of the grooves 16*a-x*.

Figure 2:
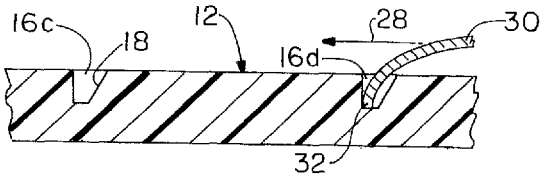
FIG. 2 is a cross-sectional view of a line threading device according to one embodiment of the invention, taken along lines 2-2.

FIG. 2 is a cross-sectional view of a line threading device according to one embodiment of the invention, taken along lines 2-2. As shown in FIG. 2, top surface 12 of device 10 includes grooves 16*c* and 16*d*, which each include entry edge 18 and are adapted to engage the leading edge 32 of a metal sheet 30 as metal sheet 30 moves in direction 28 over top surface 12. As generally shown in FIG. 2, sheet 30 may curve downward at leading edge 32. When device 10 is positioned underneath sheet 30, and sheet 30 is moving in direction 28 over top surface 12 of device 10, leading edge 32 may become lodged in groove 16.

Figure 3:
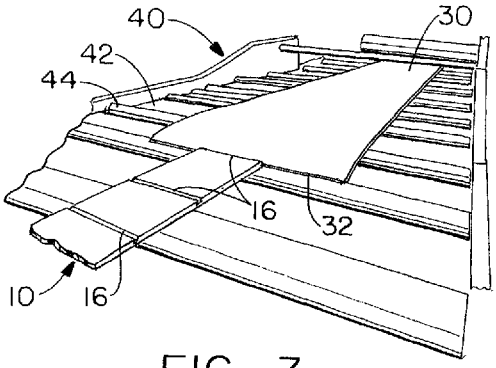
FIG. 3 is a top perspective view showing a line threading device, a metal sheet, and a process line surface according to one embodiment of the invention.

A portion of a metal sheet process line 40 is generally illustrated in FIG. 3, wherein it can be seen that process line 40 includes a process line surface 42, and that surface 42 includes one or more recesses 44. During operation of the method of the present invention, device 10 is positioned between process line surface 42 and sheet 30, at leading edge 32.

Figure 4:
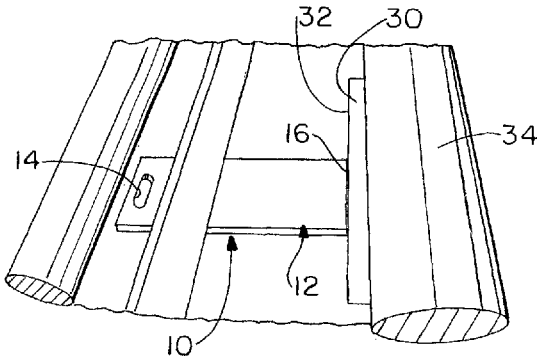
FIG. 4 is a top perspective view showing a line threading device, a metal sheet, and a process line surface according to one embodiment of the invention, and taken from another position.

This is also generally shown from another angle in FIG. 4, where is can be seen that device 10 is easily able to pass underneath or through tension rollers 34 and other equipment in the process line, along with sheet 30.

Figure 5:
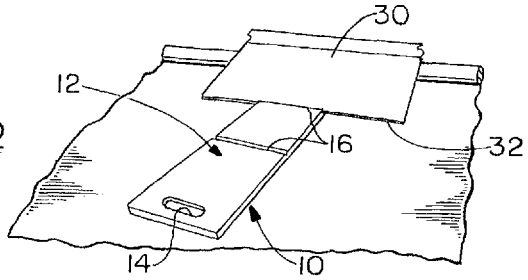
FIG. 5 is a top perspective view showing a line threading device, a metal sheet, and a process line surface according to one embodiment of the invention, and taken from another position.

FIG. 5 generally illustrates the easy accessability of handle portion 14, enabling the safe removal of device 10 from the process line prior to recoiling of the metal sheet. Advantageously, handle cutout 14 also serves to enable the device to easily hang from a hook when not in use.

The composition of the device is not particularly limited. Desirable characteristics of the composition include durability, light weight, heat resistance, chemical resistance. Rigidity of the composition should be sufficient so that the device does not bend or fold. In one or more embodiments, rigidity is maintained up to a temperature of at least about 200° F., in other embodiments up to a temperature of at least about 220° F., and in other embodiments, up to a temperature of at least about 240° F. In one or more embodiments, the chemical resistance of the composition against acids, greases and oils is good. In one or more embodiments, the device is fabricated from a composition having a low coefficient of friction with the surface of the process line, such that the device glides along easily. Examples of suitable compositions for the fabrication of the device include polycarbonates, polyurethanes and various reinforced polymer composites.

The shape of the device is not particularly limited, although the bottom surface of the device, i.e. the surface that contacts the rollers in the process line, should be substantially smooth, so that the device glides along easily and does not impede the forward progress of the sheet through the process line. In one or more embodiments, the device is substantially flat, so that when the device is in position on the process line, the device lays flat on the surface of the process line.

The dimensions of the device are not particularly limited, but can be selected based upon the dimensions of the process line, the dimensions of the sheet, the size of the recesses, the speed at which the sheet is moving along the line, and other factors that will be readily apparent to those of skill in the art. In one or more embodiments, the width of the device is from about 6 to about 72 inches, in other embodiments, from about 8 to about 60 inches, in other embodiments, from about 9 to about 49 inches, and in other embodiments, from about 10 to about 16 inches. In one or more embodiments, the length of the device is from about 24 to about 60 inches, and in other embodiments, from about 36 to about 54 inches.

The thickness of the device may be advantageously selected such that the device has adequate stiffness and durability, and is nevertheless relatively lightweight. In one or more embodiments, the thickness of the device is from about 0.2 to about 1.5 inches, in other embodiments, from about 0.25 to about 1, and in other embodiments, from about 0.3 to about 0.8 inches.

A plurality of grooves 16*a-x* are provided on top surface 12 of device 10, in order to increase the likelihood that a bent/curved leading edge 32 of sheet 30 will engage with one of the grooves. The number of grooves and the distance between the grooves is not particularly limited. In one or more embodiments, the grooves are spaced at a distance of from about 3 inches to about 9 inches, and in certain embodiments, the distance is from about 5.5 to about 6.5 inches. The grooves are purposely kept a safe distance from the handle portion of the device, so that the hand of an operator who is reaching to grab the device will be kept well away from the leading edge of the sheet. In one or more embodiments, the distance from the handle to the closest groove will be at least about 10 inches, in other embodiments, at least about 12 inches, and in other embodiments, at least about 14 inches.

In one or more embodiments, top surface 12 includes at least 2 grooves, in other embodiments, at least 3 grooves, in other embodiments, at least 4 grooves, in other embodiments, at least 5 grooves, in other embodiments, at least 6 grooves. In one or more embodiments, top surface 12 includes from 2 to 7 grooves, in other embodiments, from 3 to 6 grooves, in other embodiments, from 4 to 5 grooves.

The depth of grooves 16 is not particularly limited, but should be sufficient to engage the leading edge of the sheet, while not extending too far into the device, thereby compromising the integrity of the device. It will be understood that groove 16 could be rounded or triangular, so long as entry edge 18 of groove 16 is angled slightly away from the handle cutout 14 (towards the direction of sheet 30).

In operation, the device operates as a longitudinal movement guide, enabling the sheet to proceed along the process line, over crevices, gaps and other recesses. The device facilitates forward progress of the sheet from preventing the front edge of the sheet from becoming hung up in a recess of the process line.

Advantageously, handle cutout 14 enables an operator to easily grab onto the device to place it on the process line or to remove it from the process line. Even more advantageously, a tool having a hooked end can be employed to hook the device by way of the cutout and to pull the device off of the process line.

Various modifications and alterations that do not depart from the scope and spirit of this invention will become apparent to those skilled in the art. This invention is not to be duly limited to the illustrative embodiments set forth herein.

We claim:

1. In a method for processing coiled metal sheet, in which the coiled metal sheet is uncoiled to form a sheet having a leading edge, wherein the leading edge is advanced along a process line surface in a forward direction, wherein the leading edge may curve toward the process line surface, wherein said process line surface includes a recess, and wherein the leading edge of the sheet may become lodged in the recess, thereby impeding the forward progress of the sheet, the improvement comprising:

inserting a line threading device between the metal sheet and the process line surface at the leading edge of the metal sheet, wherein the device is rigid and adapted to glide easily along the process line surface when propelled in a forward direction, wherein the device has an upper surface that includes a plurality of grooves that run perpendicular to the forward direction, wherein the leading edge of the sheet does not come into contact with a recess of the process line surface, but instead becomes lodged in groove of the device and propels the device along the process line surface, without impedance of the forward progress of the sheet.

2. The method of claim 1, wherein the device further includes a cutout portion that allows an operator to grab the device, and that alternately allows the device to be hung from a hook when not in use.

3. The method of claim 1, wherein the device is not bonded to the metal sheet.

4. The method of claim 1, wherein the device withstands temperatures of up to about 200° F. without softening.

5. The method of claim 1, wherein the upper surface of the device includes from 2 to 7 grooves.

6. The method of claim 1, wherein the device has a low coefficient of friction relative to the process line surface.

* * * * *